US005533582A

United States Patent [19]

Tibbitts

[11] Patent Number: 5,533,582

[45] Date of Patent: Jul. 9, 1996

[54] DRILL BIT CUTTING ELEMENT

[75] Inventor: Gordon A. Tibbitts, Salt Lake City, Utah

[73] Assignee: Baker Hughes, Inc., Houston, Tex.

[21] Appl. No.: 359,187

[22] Filed: Dec. 19, 1994

[51] Int. Cl.[6] ..... E21B 10/46

[52] U.S. Cl. ..... 175/430; 175/432

[58] Field of Search ..... 175/430, 431, 175/432, 428, 429

[56] References Cited

U.S. PATENT DOCUMENTS

| | | | |
|---|---|---|---|
| 4,200,159 | 4/1980 | Peschel et al. | 175/329 |
| 4,221,270 | 9/1980 | Vezirian | 175/430 |
| 4,244,432 | 1/1981 | Rowley et al. | 175/329 |
| 4,373,410 | 2/1983 | Davis | 175/428 X |
| 4,498,549 | 2/1985 | Jurgens | 175/430 |
| 4,606,418 | 8/1986 | Thompson | 175/429 |
| 4,705,122 | 10/1987 | Wardley et al. | 175/430 |
| 4,877,096 | 10/1989 | Tibbitts | 175/432 |
| 5,011,515 | 4/1991 | Frushour | 51/307 |
| 5,348,109 | 9/1994 | Griffin | 175/434 |
| 5,373,908 | 12/1994 | Pastusek | 175/431 |

*Primary Examiner*—Hoang C. Dang

*Attorney, Agent, or Firm*—Marger, Johnson, McCollom & Stolowitz

[57] ABSTRACT

A full cutting element including a substantially cylindrical backing and cutter mounted thereon is cut generally along the length thereof to produce a pair of semicylindrical partial cutting elements. In the case of an unused cutting element, each partial cutting element is mounted on a different semicylindrical tungsten carbide base to produce a substantially cylindrical unit which is mounted on a bit using a low temperature braze. In the case of a used full cutting element, the cutting element is cut to separate the worn portion from the remainder of the bit and only the unused portion is used to form a cylindrical unit with a corresponding semicylindrical tungsten carbide base. In another aspect, a partial cutting element is received in a pocket formed on a bit body. The pocket includes a pair of opposed side surfaces which substantially flushly abut the curved surfaces of the backing on the partial cutter.

22 Claims, 3 Drawing Sheets

DRILL BIT CUTTING ELEMENT

BACKGROUND OF THE INVENTION

1. Field of the Invention

The present invention relates generally to a drill bit cutting element and method for mounting a cutting element on a drill bit and more particularly to such a cutting element and method in which a new or worn cutting clement is cut to create at least one partial cutting element.

2. Description of the Related Art

A conventional cutting clement for an earth boring drill bit typically comprises a substantially cylindrical backing made from a cemented metal carbide such as tungsten carbide. One end of the backing has a cutting blank, referred to herein as a cutter, bonded thereto. The cutter typically comprises a disk of cemented carbide having a polycrystalline compact diamond (PCD) layer formed on one end thereof which defines a cutting surface. The PCD layer may be of the type having metals leached therefrom to enable the cutting element to withstand higher temperatures. In such cases the PCD layer may comprise a mosaic of smaller PCD elements mounted on the end of the substrate. Such cutting elements are typically mounted on a drill bit body by brazing. The drill bit body is formed with recesses therein for receiving a substantial portion of the cutting element in a manner which presents the PCD layer at an appropriate angle and direction for cutting in accordance with the drill bit design. In such cases, a brazing compound is applied to the surface of the backing and in the recess on the bit body in which the cutting element is received. The cutting elements are installed in their respective recesses in the bit body and heat is applied to each cutting clement via a torch to raise the temperature to a point which is high enough to braze the cutting elements to the bit body but not so high as to damage the PCD layer.

During drilling, the cutting elements are urged against a formation. As drilling proceeds, the cutter and portions of the backing adjacent thereto tend to wear away from one side. By the time wear extends to the middle of the PCD layer, the cutting element is substantially spent and must be removed and replaced or, in some cases, the entire bit must be replaced.

Prior art half cutting elements are usually semicylindrical in shape. In the case of such a cutting element, each half cutting element includes a backing having a substantially flat side surface and a semicircular cross section. A half cutter including a PCD layer is mounted on one end of the backing. While half cutting elements are desirable because they provide all the PCD cutting surface normally used during drilling (with less PCD material), the reduced surface area of the semicylindrical backing provides less surface area for brazing the cutting element to the drill bit body. As a result, half cutting elements are relatively easier than a full cutting element to break away from the bit body. Although prior art high temperature brazes exist which provide high strength bonds, the heat required to effect the bond is high enough to damage the PCD cutting layer. Such brazes cannot be used in the process described above in which a torch is used to braze the cutting elements thereto because the cutters will be damaged.

It would be desirable to provide a half cutting element which could be mounted on a drill bit body as securely as a conventional full cutting element.

SUMMARY OF THE INVENTION

The present invention comprises a method for mounting a cutting element on an earth boring drill bit. The cutting element is of the type having a cutter mounted on a backing. The method includes the step of cutting the backing and cutter thereby forming at least one partial cutting element. The partial cutting clement is mounted on a base to form an integrated unit which is thereafter mounted on a drill bit body. A cutting element made in accordance with the method is also provided.

In another aspect of the present invention, a pocket is formed on a drill bit body for receiving a partial cutting element which is fitted into the pocket and thereafter brazed to the bit body.

It is a general object of the present invention to provide a drill bit cutting element and method for mounting a cutting element on a drill bit which overcomes the above enumerated disadvantages associated with prior art cutting elements and methods.

It is another object of the present invention to provide such a cutting element and method in which a partial cutting element is securely mounted on a drill bit body.

It is another object of the present invention to provide such a cutting element and method which is less expensive than utilizing full cutting elements and which provides a secure bond between the cutting element and the bit body.

It is another object to provide such a cutting clement and method in which a cutting element in accordance with the invention may be constructed from a partially worn prior art full cutting element.

It is another object of the present invention to utilize a high temperature braze to create a partial cutting element having a geometry similar to a full cutting element.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENT

Figure 1:
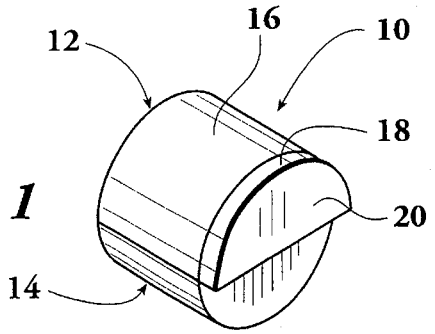
FIG. 1 is a perspective view of a first embodiment of a cutting element constructed in accordance with the present invention.

Indicated generally at 10 in FIG. 1 is a first embodiment of a cutting element constructed in accordance with the present invention. Cutting clement 10 includes a partial cutting element 12 and a base 14. Base 14 is preferably formed of tungsten carbide or of a metallic or other bondable material. In the embodiment of FIG. 1, both partial cutting element 12 and base 14 comprise substantially semicylindrical bodies bonded together, in a manner which will hereinafter more fully described, to form a substantially cylindrical unit. It should be appreciated that the present invention can be practiced with other geometries, e.g., a body having triangular or other geometrical cross section such as one half of a hexagon. Moreover, the base might comprise one geometry, e.g., semicylindrical, and the partial cutting clement another, e.g., triangular or other geometrical cross section. In the embodiment of FIG. 1, partial cutting element 12 includes a backing 16, which in the present embodiment is formed from a cemented metal carbide such as tungsten carbide. A cutter 18 is bonded to one end of backing 16 in a manner which will be more fully described hereinafter. Cutter 18 is conventional and may comprise a substrate of cemented carbide having a polycrystalline compact diamond (PCD) formed on one end to define a cutting surface 20. Cutter 18 may, e.g., alternately comprise a synthetic diamond mosaic cutter.

Figure 11:
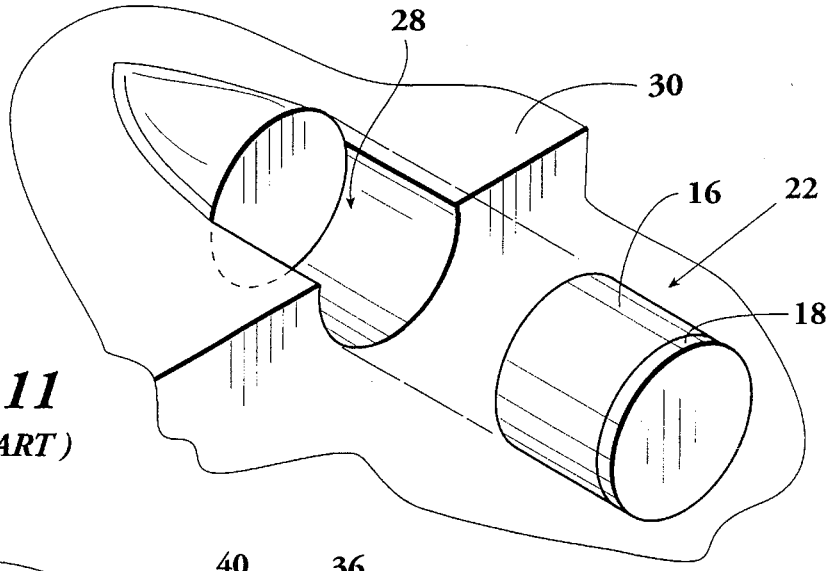
Fig. 11 ( PRIOR ART )
FIG. 11 is an exploded perspective view of a prior art drill bit illustrating the manner in which a cutting element is received in a matrix pocket of the bit.

Consideration will now be given to the manner in which cutting element 10 is manufactured. Partial cutting element 12 is obtained by cutting a prior art full cutting element, such as the one indicated generally at 22 in FIG. 11, into two halves generally along a plane containing the longitudinal axis of the cutting element. A full cutting element, like cutting element 22, can be cut immediately after it is manufactured to provide two semicylindrical partial cutting elements, like partial cutting element 12, for making two cutting elements, like cutting element 10. Alternatively, a prior art full cutting element like cutting element 22 can be installed on a bit as illustrated in FIG. 11 and used until the cutting edge is substantially worn. The worn cutting element is then removed from the bit and cut generally along a plane containing the longitudinal axis of the cutting element with the plane being oriented so that substantially all of the worn portion of the full cutting element is on one side of the plane, thereby creating a first partial cutting element which is worn and a second partial cutting element which is substantially unworn, like partial cutting element 12 in FIG. 1.

Continuing description of the manufacture of cutting clement 10, partial cutting element 12 is thereafter bonded to semicylindrical base 14. The bond so formed is a high strength bond which is heated in a small furnace, such as one that might be used for bonding synthetic diamond to an appropriate substrate as opposed to a furnace capable of receiving an entire matrix bit. The furnace is conventional and those skilled in the art can use it, along with a suitable bonding material, to form a high strength bond between the planar surfaces of partial cutting element 12 and base 14. In part, this is accomplished by heating the base and partial cutting element in a manner which would damage cutter 18 except that conventional cooling equipment is used for cooling the cutter during the high strength bonding process. The high strength bond is thus formed between partial cutting clement 12 and base 14 by heating both bodies to a level which would damage the cutter if the same heat was applied thereto during a conventional brazing process in which each of the cutters are heated with a torch.

After cutting element 10 is manufactured as described above, it is installed in a known manner on a bit crown. The technique for installing cutting element 10 includes utilizing a conventional brazing material between both backing 16 and base 14 and the surfaces of a pocket, like pocket 28 formed in an earth-boring drill bit body 30 in FIG. 11. As used herein, the term conventional brazing refers to brazing accomplished with low moderate temperatures which are not high enough to damage the PDC layer in the cutter. Such conventional brazing can produce bonds in the range of 35,000 to 140,000 p.s.i. shear strength. The term high temperature brazing refers to brazing accomplished with a temperature which is high enough to damage the PDC layer in the cutter in the absence of cooling during brazing. Such high temperature brazing can produce bonds having even higher shear strength than conventional brazing and are known in the art.

With continued reference to FIG. 11, cutting element 10 is oriented to present cutter 18 at an appropriate angle so that a curved edge thereof is presented to an earth formation during drilling. After the cutting elements are set into the pockets with a suitable brazing material, each cutting element is heated, typically with a torch, to produce a low to moderate temperature bond between the cutting elements and the bit body. Because cutting element 10 includes substantially more surface area than a partial cutting element, the low temperature bond is sufficient to retain the cutting element in its pocket during drilling. Although there is a relatively small surface area between base 14 and backing 16, the high temperature bonding process described above produces a high strength bond which maintains its integrity during drilling.

It should be noted that the brazing step required to join partial cutting element 12 and base 14, in FIG. 1, could be accomplished with a moderate temperature conventional braze and the brazing required to install cutting element 10 into the bit crown pockets could be accomplished with a low temperature conventional braze as described above. It is important that the braze used to join cutting element 12 and base 14 have a higher brazing temperature than that used to install cutting element 10 into a bit crown pocket to prevent debrazing of the bond in cutting element 10 when it is brazed into its associated bit crown pocket.

Figure 2:
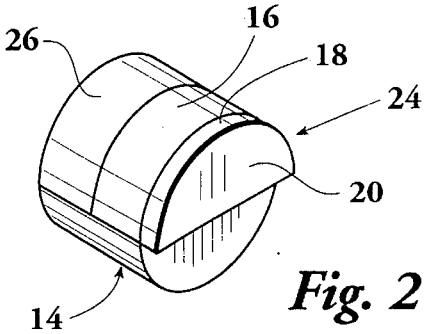
FIG. 2 is a perspective view of a second embodiment of a cutting element.

Turning now to FIG. 2, a second cutting element 24 which is constructed in accordance with the present invention is illustrated. The numbers used in FIG. 2 and previously appearing in FIG. 1 correspond generally to the previously identified structure. In the embodiment of FIG. 2, backing 16 is shorter than cutting element 10. Another substantially semicylindrical body portion 26 is received against one end of backing 16 and is likewise abutted against base 14 as shown. Brazing is provided as described above between the surfaces of backing 16 and cutting element 26 which are abutted against base 14 as well as the surfaces of backing 16 and body portion 26 which are directly abutted together. Cutting element 24 may be used in substantially the same manner as cutting element 10.

Figure 3:
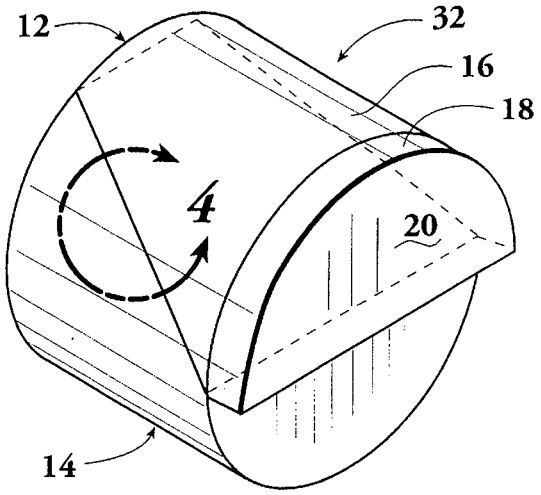
FIG. 3 is a perspective view of a third embodiment of a cutting element comprising a partial cutting element and a base and showing a substantially planar boundary between the two.

Turning now to FIG. 3, indicated generally at 32 is another cutting element constructed in accordance with the present invention. In the embodiment of FIG. 3, which is manufactured and used substantially as described above, neither partial cutting element 12 nor base 14 is substantially semicylindrical. Each does, however, include a complimentary substantially planar brazing surface, the boundary of which is shown partially in dashed lines and partially in a solid line, so that when the two are bonded together, a substantially cylindrical unit, as in the cutting elements of FIGS. 1 and 2, is formed.

Figure 4:
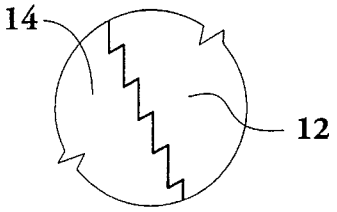
FIG. 4 is a sectional view illustrating a portion of another embodiment of the cutting element of FIG. 3 and depicting a slightly different boundary than the planar boundary along line 4—4 in FIG. 3.
Figure 5:
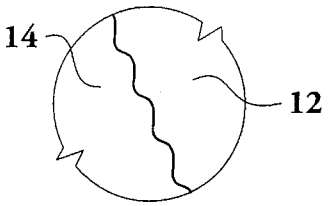
FIG. 5 is a view similar to the view of FIG. 4 illustrating another embodiment of the cutting element of FIG. 3 and depicting a slightly different structure at the boundary.
Figure 6:
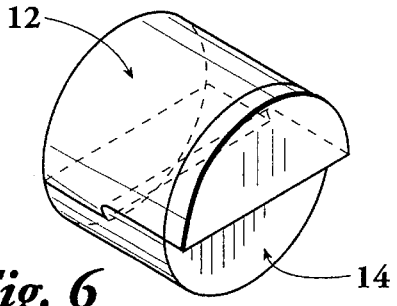
FIG. 6 is another embodiment of the cutting element of the present invention illustrating a boundary having complementary geometric features between a partial cutter and a base.
Figure 7:
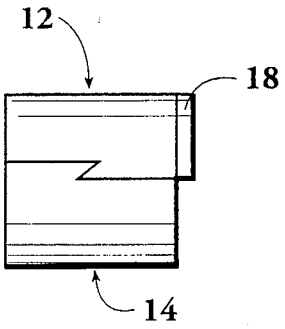
FIGS. 7–10 are embodiments similar to FIG. 6 showing different complementary geometric features.
Figure 8:
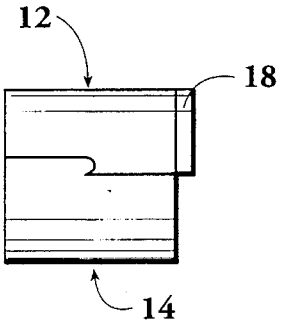
Figure 9:
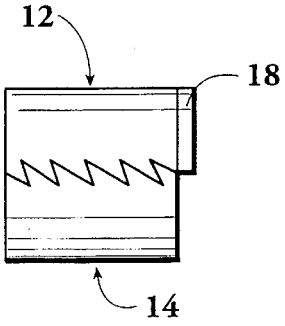

Turning now to FIG. 4, shown therein is an enlarged view of the boundary between a partial cutting element and body, like partial cutting element 12 and body 14 in FIG. 3, in a modified version of the cutter of FIG. 3. As can be seen, partial cutting element 12 and body 14 include complementary geometric features which interface with one another to resist shear forces applied to partial cutting element 12 during drilling which tend to break the bond between the partial cutting element and the base. FIG. 5 illustrates another modified version of the boundary between the partial cutting element and the base also including complementary geometric features which resist shear forces. Such features may be incorporated into an embodiment in which the partial cutting element is not cut from a full cutting element along a cutting plane containing the longitudinal axis of the full cutting element, as in FIG. 3, or may be incorporated into cutting elements like those shown in FIGS. 6–9 and in FIG. 10 where only a partial cutting element 12 is shown to illustrate an interfacing feature 33 formed thereon. A complementary recess is formed in a semicylindrical base (not shown) to engage the feature 33 so as to resist shear forces during drilling.

Turning now to FIG. 11, full cutting element 22 includes a substantially cylindrical backing 16 and a cutter 18. Cutting element 22 may be cut as described above to form partial cutters utilized in the present invention. Also as described above, prior art full cutting element 22 is brazed into corresponding pocket 28 formed in bit body 30 utilizing conventional brazing techniques which involve placing a suitable conventional braze and a full cutting element, like full cutting element 22 in each pocket. Thereafter, brazing is accomplished by heating the cutter, the surrounding pocket and the braze with a torch.

Figure 12:
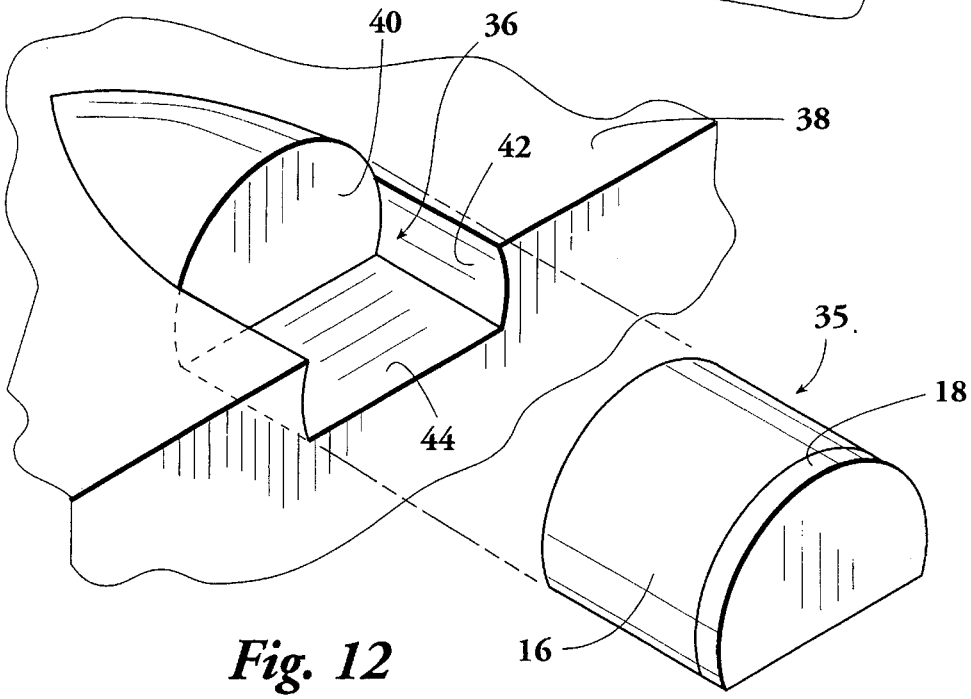
FIG. 12 is a cutting element and pocket constructed in accordance with the present invention.

In another aspect of the invention depicted in FIG. 12, a partial cutter 35 may be received into a pocket, indicated generally at 36, formed on a drill bit body 38. Partial cutter 35 is formed in the same manner as the previously described partial cutters, namely by cutting a full cutting element generally along the length thereof. In the embodiment of FIG. 12, a lower substantially planar surface, not visible, is formed during the cutting process which is substantially parallel to the longitudinal axis of the full cutting element.

Pocket 36 includes a substantially planar rear surface 40, a curved surface 42 and a substantial planar surface 44 which flushly abuts the cut surface of partial cutter 35 when the stone is received in pocket 36. A surface (not visible) symmetrical with and opposite to surface 44 comprises a portion of pocket 36. As with the prior art technique described in connection with FIG. 11, a suitable conventional bonding material is placed in pocket 36, on the rear planar surface of backing 16, on the lower planar surface of backing 16 and on the curved lower side surfaces, like surface 42, of the backing. Thus, when partial cutter 35 is received in pocket 36, bonding material is disposed between substantially all of the abutting surfaces of the pocket and partial cutter 35. Thereafter, the cutters surrounding the pockets and braze are heated with a torch to braze the cutters into the pockets.

Because the partial cutter and pocket depicted in FIG. 12 provide increased area of contact between the pocket and cutter over prior art techniques for mounting half cutters on bits, and because curved surface 42 and the opposing symmetrical surface tend to retain the partial cutter in the pocket, the bond between the partial cutter and the pocket is able to withstand the forces applied during drilling.

Figure 10:
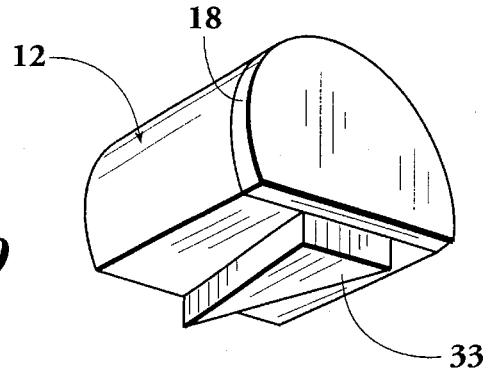

The cutter of FIG. 10 may be received into a pocket, like pocket 36 in FIG. 12, having a recess complementary to feature 33 formed on surface 44 in order to provide increased mechanical resistance to shear forces.

Figure 13:
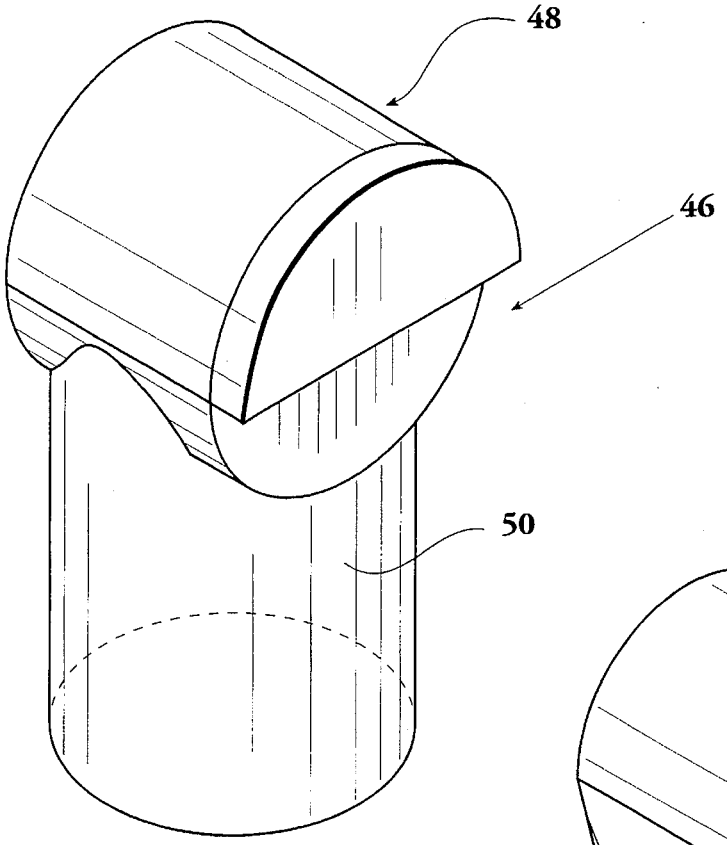
FIG. 13 is a perspective view of a stud cutter constructed in accordance with the present invention.

Turning now to FIG. 13, indicated generally at 46 is a stud cutter constructed in accordance with the present invention. Included therein is a cutting element 48 similar to cutting element 10 in FIG. 1. The cutting element is mounted on a stud 50, which may be formed from tungsten carbide or may be metallic or other suitable material. Preferably cutting element 48 is mounted on the stud utilizing high temperature brazing. The cutting element may be mounted on the stud using any of the brazing or bonding techniques referred to above or with another suitable technique for securely mounting the cutting element on the stud. Stud cutter 46 is mounted, along with other similar stud cutters, on the bit body to create a stud cutter bit.

Figure 14:
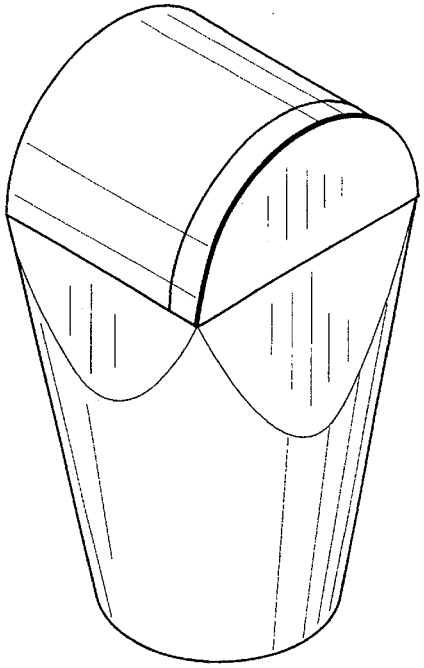
FIG. 14 is a perspective view of another embodiment of a stud cutter constructed in accordance with the present invention.
Figure 15:
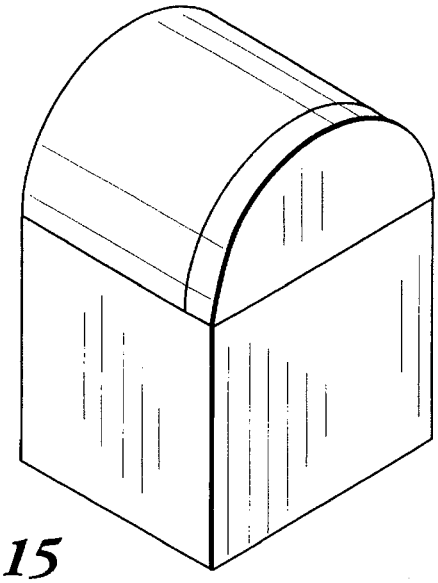
FIG. 15 is a perspective view of another embodiment of a stud cutter constructed in accordance with the present invention.

FIGS. 14 and 15 illustrate different embodiments of stud cutters in which a half cutter, formed by cutting a new or worn cutter as described above, is brazed to the upper surface of a stud preferably using high temperature brazing.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

What is claimed is:

1. A cutting element for an earth boring drill bit comprising:

a backing formed from a cemented metal carbide and having a substantially semicylindrical shape which includes a generally longitudinal substantially planar surface;

a cutter mounted on one end of the backing, said cutter comprising a substrate having a PCD layer formed thereon; and a substantially semicylindrical base which includes a generally longitudinal substantially planar surface, said base being mounted on the backing by a bonding layer formed between said substantially planar surfaces.

2. The cutting element of claim 1 wherein said base is substantially in the shape of a half cylinder and is bonded to said backing so as to form a cutting element having a generally cylindrical shape.

3. The cutting element of claim 1 wherein said backing and said base include complementary geometric features which interlock with one another.

4. The cutting element of claim 1 wherein said bonding layer extends substantially to at least one of a front surface of said cutting element and a rear surface of said cutting element.

5. The cutting element of claim 1 wherein said bonding layer comprises a high strength bond.

6. The cutting element of claim 5 wherein said high strength bond comprises a high temperature braze.

7. The cutting element of claim 6 wherein said cutting element is mounted on a drill bit body in a generally cylindrical pocket by a bonding layer comprising a conventional braze.

8. The cutting element of claim 7 wherein said cutting element is generally cylindrical and includes a substantially planar rear surface which flushly abuts a corresponding surface in a drill bit pocket when said cutting element is mounted on a drill bit body.

9. The cutting element of claim 4 wherein said backing and said base include complementary geometric features which interlock with one another.

10. The cutting element of claim 4 wherein said bonding layer extends substantially to both said front and rear surfaces of said cutting element.

11. The cutting element of claim 1 wherein said cutter is substantially coextensive with said one end of the backing on which the cutter is mounted.

12. A stud cutter for an earth boring drill bit comprising:

a stud;

a backing formed from a cemented metal carbide and having a substantially semicylindrical shape which includes a generally longitudinal substantially planar surface;

a bonding layer formed between said substantially planar surface and said stud and bonding the two together;

a cutter mounted on one end of the backing, said cutter comprising a substrate having a PCD layer formed thereon.

13. The stud cutter of claim 12 wherein said bonding layer comprises a high strength bond.

14. The stud cutter of claim 13 wherein said high strength bond comprises a high temperature braze.

15. The stud cutter of claim 14 wherein said bonding layer extends to a front surface of said stud cutter and to a rear surface of said stud cutter.

16. The stud cutter of claim 15 wherein said cutter is substantially coextensive with said one end of the backing on which the cutter is mounted.

17. A stud cutter for an earth boring drill bit comprising:

a cutting element, including:

a backing formed from a cemented metal carbide and having a substantially semicylindrical shape which includes a generally longitudinal substantially planar surface;

a cutter mounted on one end of the backing, said cutter comprising a substrate having a PCD layer formed thereon; and a substantially semicylindrical base which includes a generally longitudinal substantially planar surface, said base being mounted on the backing by a first bonding layer formed between said substantially planar surfaces;

a stud; and a second bonding layer formed between said stud and said cutting element and bonding the two together.

18. The stud cutter of claim 17 wherein said first bonding layer comprises a high strength bond.

19. The stud cutter of claim 18 wherein said high strength bond comprises a high temperature braze.

20. The stud cutter of claim 17 wherein said second bonding layer comprises a high strength bond.

21. The stud cutter of claim 20 wherein said high strength bond comprises a high temperature braze.

22. The stud cutter of claim 17 wherein said cutter is substantially coextensive with said one end of the backing on which the cutter is mounted.

* * * * *

UNITED STATES PATENT AND TRADEMARK OFFICE

CERTIFICATE OF CORRECTION

PATENT NO. 5,533,582
DATED Jul. 9, 1996
INVENTOR(S) Tibbitts

It is certified that error appears in the above-indentified patent and that said Letters Patent is hereby corrected as shown below:

Column 4, line 18, "low moderate" should read --low to moderate--.

Signed and Sealed this

Fourteenth Day of July, 1998

Bruce Lehman

*Attest:*

BRUCE LEHMAN

*Attesting Officer*

*Commissioner of Patents and Trademarks*